US010623882B1

(12) United States Patent
Liang

(10) Patent No.: US 10,623,882 B1
(45) Date of Patent: Apr. 14, 2020

(54) SOUNDING SYSTEM AND SOUNDING METHOD

(71) Applicant: xMEMS Labs, Inc., Los Altos, CA (US)

(72) Inventor: Jemm Yue Liang, Sunnyvale, CA (US)

(73) Assignee: xMEMS Labs, Inc., Los Altos, CA (US)

( * ) Notice: Subject to any disclaimer, the term of this patent is extended or adjusted under 35 U.S.C. 154(b) by 0 days.

(21) Appl. No.: 16/583,282

(22) Filed: Sep. 26, 2019

Related U.S. Application Data

(60) Provisional application No. 62/828,483, filed on Apr. 3, 2019.

(51) Int. Cl.

| | |
|---|---|
| ***H04S 7/00*** | (2006.01) |
| ***H04R 1/40*** | (2006.01) |
| ***H04R 3/12*** | (2006.01) |
| ***H04R 5/02*** | (2006.01) |
| ***H04S 3/00*** | (2006.01) |
| ***H04R 3/04*** | (2006.01) |

(52) U.S. Cl.
CPC ..... *H04S 7/303* (2013.01); *H04R 1/403* (2013.01); *H04R 3/04* (2013.01); *H04R 3/12* (2013.01); *H04R 5/02* (2013.01); *H04S 3/008* (2013.01); *H04S 2400/01* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,515,997 | A * | 5/1985 | Stinger, Jr. | H04R 19/02 341/151 |
| 8,594,350 | B2 * | 11/2013 | Hooley | H04S 7/301 381/150 |
| 2006/0050897 | A1 * | 3/2006 | Asada | H04R 3/12 381/98 |
| 2013/0044904 | A1 * | 2/2013 | Margalit | H04R 17/00 381/182 |
| 2017/0180855 | A1 * | 6/2017 | Lee | H04R 3/04 |
| 2017/0201192 | A1 | 7/2017 | Tumpold | |

FOREIGN PATENT DOCUMENTS

| | | | | |
|---|---|---|---|---|
| EP | 1122973 | A2 * | 8/2001 | H04R 1/005 |

* cited by examiner

*Primary Examiner* — Akelaw Teshale
(74) *Attorney, Agent, or Firm* — Winston Hsu

(57) ABSTRACT

A sounding system is provided. The sounding system comprising a sound producing device, disposed at a sound producing location, receiving a sounding sequence, configured to produce a sounding pulse array according to the sounding sequence; and a sounding circuit, comprising a sensor, disposed at a sound constructing location, receiving a received sounding pulse array corresponding to the sounding pulse array; a filtering circuit, configured to perform a filtering operation on the received sounding pulse array according to the sounding sequence and the sounding pulse waveform, and generate an overall filtering result; and a spike detection circuit, configured to perform a spike detection operation on the overall filtering result and obtain a channel impulse response corresponding to a channel between the sound producing location and the sound constructing location.

29 Claims, 10 Drawing Sheets

SOUNDING SYSTEM AND SOUNDING METHOD

CROSS REFERENCE TO RELATED APPLICATIONS

This application claims the benefit of U.S. provisional application No. 62/828,483, filed on Apr. 3, 2019, which is incorporated herein by reference.

BACKGROUND OF THE INVENTION

1. Field of the Invention

The present application relates to a sounding system and a sounding method, and more particularly, to a sounding system and a sounding method capable of being performed efficiently.

2. Description of the Prior Art

Speaker driver is always the most difficult challenge for high-fidelity sound reproduction in the speaker industry. The physics of sound wave propagation teaches that, within the human audible frequency range, the sound pressures generated by accelerating a membrane of a conventional speaker driver may be expressed as $P \propto SF \cdot AR$, where SF is the membrane surface area and AR is the acceleration of the membrane. Namely, the sound pressure P is proportional to the product of the membrane surface area SF and the acceleration of the membrane AR. In addition, the membrane displacement DP may be expressed as $DP \propto \frac{1}{2} \cdot AR \cdot T^2 \propto 1/f^2$, where T and f are the period and the frequency of the sound wave respectively. The air volume movement $V_{A,CV}$ caused by the conventional speaker driver may then be expressed as $V_{A,CV} \propto SF \cdot DP$. For a specific speaker driver, where the membrane surface area is constant, the air movement $V_{A,CV}$ is proportional to $1/f^2$, i.e., $V_{A,CV} \propto 1/f^2$.

To cover a full range of human audible frequency, e.g., from 20 Hz to 20 KHz, tweeter(s), mid-range driver(s) and woofer(s) have to be incorporated within a conventional speaker. All these additional components would occupy large space of the conventional speaker and will also raise its production cost. Hence, one of the design challenges for the conventional speaker is the impossibility to use a single driver to cover the full range of human audible frequency.

Another design challenge for producing high-fidelity sound by the conventional speaker is its enclosure. The speaker enclosure is often used to contain the back-radiating wave of the produced sound to avoid cancelation of the front radiating wave in certain frequencies where the corresponding wavelengths of the sound are significantly larger than the speaker dimensions. The speaker enclosure can also be used to help improve, or reshape, the low-frequency response, for example, in a bass-reflex (ported box) type enclosure where the resulting port resonance is used to invert the phase of back-radiating wave and achieves an in-phase adding effect with the front-radiating wave around the port-chamber resonance frequency. On the other hand, in an acoustic suspension (closed box) type enclosure, the enclosure functions as a spring which forms a resonance circuit with the vibrating membrane. With properly selected speaker driver and enclosure parameters, the combined enclosure-driver resonance peaking can be leveraged to boost the output of sound around the resonance frequency and therefore improve the performance of resulting speaker.

To overcome the design challenges of speaker driver and enclosure within the sound producing industry, a PAM-UPA sound producing scheme has been proposed. Furthermore, the PAM-UPA sound producing scheme taking "multipath channel effect" into consideration has been proposed. Conventionally, a sounding operation is needed to obtain a channel impulse response. The sounding operation is performed in a channel probing phase, which is separated from a transmission phase. It means that the listener/user has to wait until the channel probing phase is expired and then can hear the audio content, which degrades the user experience.

Therefore, it is necessary to improve the prior art.

SUMMARY OF THE INVENTION

It is therefore a primary objective of the present application to provide a sounding system and a sounding method capable of being performed efficiently.

An embodiment of the present application provides a sounding system, configured to perform a sounding operation, the sounding system comprising a sound producing device, disposed at a sound producing location, receiving a sounding sequence, configured to produce a sounding pulse array according to the sounding sequence, wherein the sounding pulse array comprises a plurality of sounding pules, and each sounding pulse is corresponding to a sounding pulse waveform; and a sounding circuit, comprising a sensor, disposed at a sound constructing location, receiving a received sounding pulse array corresponding to the sounding pulse array, wherein the received sounding pulse array comprises a plurality of received sounding pulses; a filtering circuit, coupled to the sensor, configured to perform a filtering operation on the received sounding pulse array according to the sounding sequence and the sounding pulse waveform, and generate an overall filtering result; and a spike detection circuit, coupled to the filtering circuit, configured to perform a spike detection operation on the overall filtering result and obtain a channel impulse response corresponding to a channel between the sound producing location and the sound constructing location; wherein the sounding system is integrated into a sound producing system; wherein the sound producing system comprises the sound producing device disposed at the sound producing location; wherein the sound producing device produces a pulse array corresponding to an input audio signal, and the pulse array comprises a plurality of air pulses; wherein the pulse array is emitted from the sound producing location, propagates through the channel, such that a sound pressure level envelope corresponding to the input audio signal is constructed at the sound constructing location.

An embodiment of the present application provides a sounding method, comprising: producing a sounding pulse array according to a sounding sequence, wherein a correlation of the sounding sequence and a time-shifted version of the sounding sequence is less than a first threshold, the sounding pulse array comprises a plurality of sounding pules, and each sounding pulse is corresponding to a sounding pulse waveform; receiving a received sounding pulse array corresponding to the sounding pulse array, wherein the received sounding pulse array comprises a plurality of received sounding pulses; performing a filtering operation on the received sounding pulse array according to the sounding sequence and the sounding pulse waveform, and generate an overall filtering result; and performing a spike detection operation on the overall filtering result and obtain a channel impulse response corresponding to a channel between a sound producing location and a sound constructing location.

These and other objectives of the present invention will no doubt become obvious to those of ordinary skill in the art after reading the following detailed description of the preferred embodiment that is illustrated in the various figures and drawings.

DETAILED DESCRIPTION

In the present application, a signal a or an impulse response b can be interchangeably expressed in continuous-time function a(t) or b(t) of time t. The term "coupled" in the present application is referred to either a direct or an indirect connection means. Further, the term "coupled" in the present application may refer to either a wireless connection means or a wireline connection means. For example, "a first circuit is coupled to a second circuit" may refer that "the first circuit is connected to the second circuit via a wireless connection means", or "the first circuit is connected to the second circuit via a wireline connection means".

Figure 1:
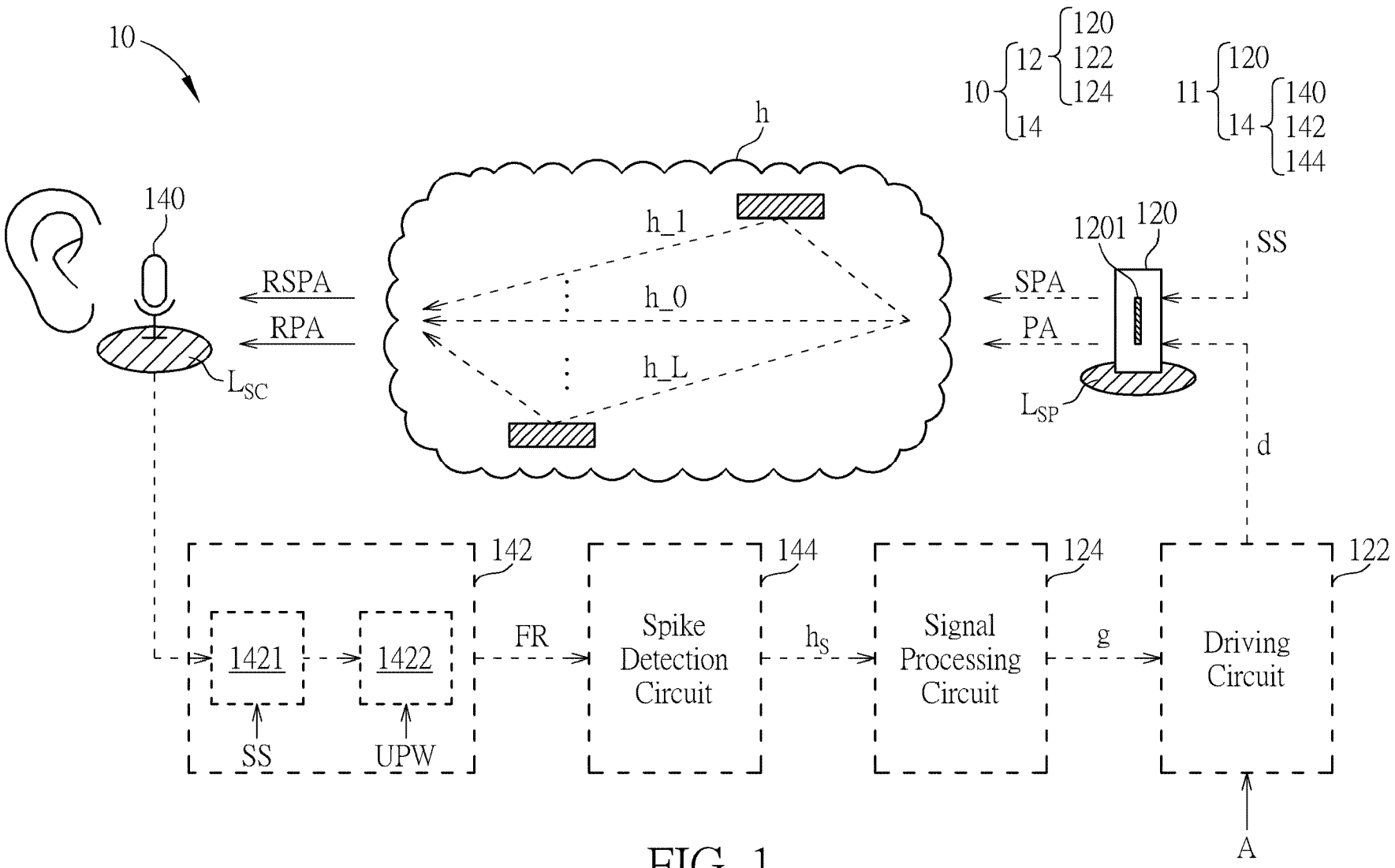
FIG. 1 is a schematic diagram of a sound producing system according to an embodiment of the present application.

FIG. 1 is a schematic diagram of a sound producing system 10 according to an embodiment of the present application. The sound producing system 10 is similar to the sound producing system disclosed in the U.S. patent application Ser. No. 16/551,685 filed by Applicant. The sound producing system 10 may be disposed in a walled-in environment e.g., an office, a living room, an exhibition hall, or inside a vehicle. The sound producing system 10 comprises a sound producing apparatus 12 and a sounding circuit 14. The sound producing apparatus 12 comprises a sound producing device (SPD) 120, a driving circuit 122 and a signal processing circuit 124. The sounding circuit 14 comprises a sensor 140, a filtering circuit 142 and a spike detection circuit 144. The SPD 120 is disposed at a sound producing location/point $L_{SP}$, and the sensor 140 is disposed at a sound constructing location/point $L_{SC}$. The sound constructing location $L_{SC}$ is preferably near an ear of a listener.

The sound producing apparatus 12 is configured to perform a sound producing operation, in which the SPD 120 produces a pulse array PA, where the pulse array PA is generated corresponding to an input audio signal A, and comprises a plurality of air pulses P. The SPD 120 is driven by a driving signal d, generated by the driving circuit 122, to produce the pulse array PA or equivalently the plurality of air pulses P. The SPD 120, comprising a membrane 1201, can be realized by the air pulse generating elements or the sound producing devices disclosed in application Ser. No. 16/125,761, Ser. No. 16/172,876, Ser. No. 16/161,097, Ser. No. 16/368,870 and Ser. No. 16/420,141, filed by Applicant, meaning that the SPD 120 may be a MEMS (micro electrical mechanical system) device. The plurality of air pulses P and the air pulse array PA, caused by the membrane vibration and produced by the SPD 120, would inherit the air pulse characteristics disclosed in U.S. application Ser. No. 16/125,761, in which the plurality of air pulses P has an air pulse rate (e.g., 40 KHz) higher than a maximum human audible frequency, and each one of the plurality of air pulses P generated by the SPD 120 would have non-zero offset in terms of sound pressure level (SPL), where the non-zero offset is a deviation from a zero SPL. In addition, the plurality of air pulses P generated by the SPD 120 is aperiodic over a plurality of pulse cycles. Details of the "non-zero SPL offset" and the "aperiodicity" properties may be referred to U.S. application Ser. No. 16/125,761, and details of the device 120 may be referred to the applications listed in the above, which are not narrated herein for brevity.

The driving circuit 122 receives the input audio signal A and a channel-shaping signal g and generates the driving signal d. In an embodiment, the driving circuit 122 is configured to perform a (linear) convolution operation on the input audio signal A(t) and the channel-shaping signal g(t), so as to generate the driving signal d(t) as $d(t)=A(t)\otimes g(t)$, where $\otimes$ denotes the linear convolution operation and the linear convolution is represented as $A(t)\otimes g(t)=\int A(\tau)\cdot g(t-\tau)d\tau$, which is known by the art.

The signal processing circuit 124 is configured to perform a signal processing operation, e.g., a time reversing operation, on the estimated channel impulse response (CIR) $h_S$ (or $h_S(t)$) of a multipath channel h, so as to generate the channel-shaping signal g. The multipath channel h is between the sound producing location $L_{SP}$ and the sound constructing location $L_{SC}$, and comprises a plurality of channel paths h_0, . . . h_L. Mathematically, the channel impulse response h(t) of the channel h can be expressed as $h(t)=\Sigma_l h_l\cdot\delta(t-\tau_l)$, where $\tau_l$ represents a sound wave propagation delay corresponding to the l-th channel path h_l between sound producing location $L_{SP}$ and sound constructing location $L_{SC}$.

The signal processing circuit 124 would generate the channel-shaping signal g such that the channel-shaping signal g(t) is proportional to a time-reversed or a time-reversed-and-conjugated counterpart of the estimated CIR $h_{Ss}(t)$ of the channel h. That is, the channel-shaping signal g(t) reflects the feature/waveform of $h_S(-t)$ or $h_S^*(-t)$, regardless of translation in time, where ( )* denotes a complex conjugate operation. Practically, the channel-shaping signal g(t) may be expressed as $g(t)=a\cdot h_S(T-t)$ or $g(t)=a\cdot h_S^*(T-t)$, where a is a constant. In an embodiment, T may be greater than or equal to the maximum propagation delay of the channel h. The operation of generating, e.g., $g(t)=a\cdot h_S(T-t)$, according to $h_S(t)$ is referred to as the time reversing operation.

The SPD 120 and the sounding circuit 14 form a sounding system 11, which can be viewed that the sounding system 11 is integrated in/into the sound producing system 10.The sounding system 11 or the sounding circuit 14 is configured to perform a sounding operation on the multipath channel h, i.e., to generate the estimated CIR $h_S$ for the sound producing apparatus 12 or for the signal processing circuit 124, such that a time reversal transmission can be performed. Therefore, a sound pressure level (SPL) envelop of a received pulse array RPA, perceived at the sound constructing location $L_{SC}$ and by the listener, is re-constructed or constructed as the input audio signal A(t) at the sound constructing location $L_{SC}$, given the estimated CIR $h_S$ is provided by the sounding circuit 14 to the signal processing circuit 124. Details of the time reversal transmission can be referred to Ser. No. 16/551,685, which is not narrated herein for brevity.

Similar to Ser. No. 16/551,685, the device 120 is physically disposed at the sound producing location $L_{SP}$ and the sensor 140 is physically disposed at the sound constructing location $L_{SC}$. The rest of the circuits, such as the filtering circuit 142, the spike detection circuit 144, the signal processing circuit 124 and the driving circuit 122, can be disposed at any location, not limited to the sound producing location $L_{SP}$ and the sound constructing location $L_{SC}$, which are illustrated in dashed line in FIG. 1.

For the sounding operation, the pulse generating device 120 receives a sounding sequence SS, and is configured to produce a sounding pulse array SPA according to the sounding sequence SS. The sounding pulse array SPA comprises a plurality of sounding pulse SP, and each sounding pulse SP may have (or be corresponding to) a sounding pulse waveform UPW (which can be expressed as p(t)), where the sounding pulse waveform UPW may be determined by the hardware characteristic of the pulse generating device 120.

The plurality of sounding pules SP and/or the sounding pulse array SPA, corresponding the sounding sequence SS, is produced by the pulse generating device 120 and emitted from the sound producing location $L_{SP}$, propagates through the multipath channel h, and arrives at the sound constructing location $L_{SC}$, such that the sensor 140 would receive a received sounding pulse array RSPA corresponding to the sounding pulse array SPA, in terms of SPL. The received sounding pulse array RSPA comprises a plurality of received sounding pulses RSP. The sensor 140 would convert the received sounding pulse array RSPA in terms of SPL into electric signal. A signal component corresponding to the received sounding pulse array RSPA within an output of the sensor 140 is also called as the received sounding pulse array RSPA.

The sounding sequence SS is a pseudo random sequence or a low auto-correlation sequence, which implies that a correlation of the sounding sequence SS and a time-shifted version of the sounding sequence SS (called an auto-correlation of the sounding sequence SS in the present application) is low, i.e., less than a first threshold, where the first threshold may be 1% of an energy of the sounding sequence (SS).

Mathematically, supposed that the sounding sequence SS is expressed as SS[n] in discrete time sequence, and SS[n−k] represents the time-shifted version of the sounding sequence SS, where n and k denote time index and delay index, respectively. The sounding sequence SS satisfies that the correlation between SS[n] and SS[n−k], denoted as <SS[n], SS[n−k]>, is less than the first threshold. <.,.>denotes a correlation operator, and a correlation between two sequences $a_n$ and $b_n$ may be defined as $\langle a_n, b_n\rangle=\Sigma_n a_n \cdot b_n$ or $\langle a_n, b_n\rangle=\Sigma_n a_n \cdot b_n^*$, where "·" represents multiplication.

In an embodiment, the sounding sequence SS may be generated via a quality check process. The quality check process is to make sure that the auto-correlation of the sounding sequence SS is sufficiently low. For example, SS[n] may be expressed as $SS[n]=\Sigma_m s_m \cdot \delta[n-m]$ or $SS=\{S_0, \ldots, S_m, \ldots, S_{M-1}\}$, where $S_m$ represents a sequence element here and δ[n] represents Dirac delta function, i.e., δ[n]=1 for n=0 and δ[n]=0 for n≠0, and M represents a sequence length. The sequence element $S_m$ may be randomly generated starting from m=0 until m=M−1. Once the sequence element $S_m$ is randomly generated, the sequence $\{S_0, \ldots, S_m\}$ would be performed the quality check process. If the quality check succeeds, then go ahead to generate the next sequence element $S_{m+1}$. Otherwise, if the quality check fails, the sequence element $S_m$ is again re-generated (randomly). The sequence element $S_m$ is kept re-generated until the sequence $\{S_0, \ldots, S_m\}$ passes the quality check. The sequence element $S_m$ may be corresponding to a binary value, e.g., $S_m \in\{+1, -1\}$, ora ternary value, e.g., $S_m \in\{+1, 0, -1\}$. The quality check process is not limited. For example, the quality check may be determining whether "a time gap between two successive corresponding sounding pulses ≥16 μs (microsecond)", "a number of successive sequence elements with same polarity ≤3", "a number of positive sequence element equals a number of negative sequence element ±1", etc.

In an embodiment, the sounding sequence SS may comprise 2048 sequence elements corresponding to the set of {+1, −1}. The 2048 corresponding sounding pules SP, comprising 1024 positive sounding pulses SP and 1024 negative sounding pulses SP, are scattered/distributed over a time span of 32.768 ms (millisecond), and a time gap between two peaks of two consecutive sounding pules SP is 16 μs.

In an embodiment, the sounding sequence SS may comprise 384 positive sequence elements with values corresponding to +1, 384 negative sequence elements with values corresponding to −1, and the rest sequence elements with values corresponding to 0. The corresponding 768 sounding pules SP are distributed pseudo randomly among 8192 (8K) possible time ticks, where the gap between successive time ticks is 4 μs and the total time span of the 16 k time-ticks is 32.768 ms.

In an embodiment, the sounding sequence SS may be realized by the well-developed pseudo-noise (PN) sequence, which is widely exploited in CDMA (code divisional multiple access) communication systems or DSSS (direct-sequence spread spectrum) communication systems. The PN sequence is famous about its low auto-correlation and orthogonality between two distinct PN sequences, which can be easily generated by a low complexity linear-feedback shift register (LFSR). Details of the PN sequence are known by the art, which is not narrated herein.

The filtering circuit 142 is coupled to the sensor 140, configured to receive the received sounding pulse array RSPA as the electric signal, perform a filtering operation on the received sounding pulse array RSPA, and generate an overall filtering result FR. The filtering operation of the filtering circuit 142 is performed according to the low auto-correlation sounding sequence SS and also the sounding pulse waveform UPW.

In the embodiment illustrated in FIG. 1, the filtering circuit 142 may comprise a first filter 1421 and a second filter 1422. The first filter 1421 may be a finite impulse response (FIR) filter with integer coefficients. The first filter 1421 is configured to perform a sequence level filtering operation, and a first impulse response H1[n] of the first filter 1421 comprises a component which is proportional to a time-reversed or a time-reversed-and-conjugated version of the sounding sequence SS. For example, the first impulse response H1[n] can be mathematically expressed as H1[n]=SS[−n], H1[n]=SS[−n]*, H1[n]=SS[M−n] or H1[n]=SS[M−n]*.

Figure 2:
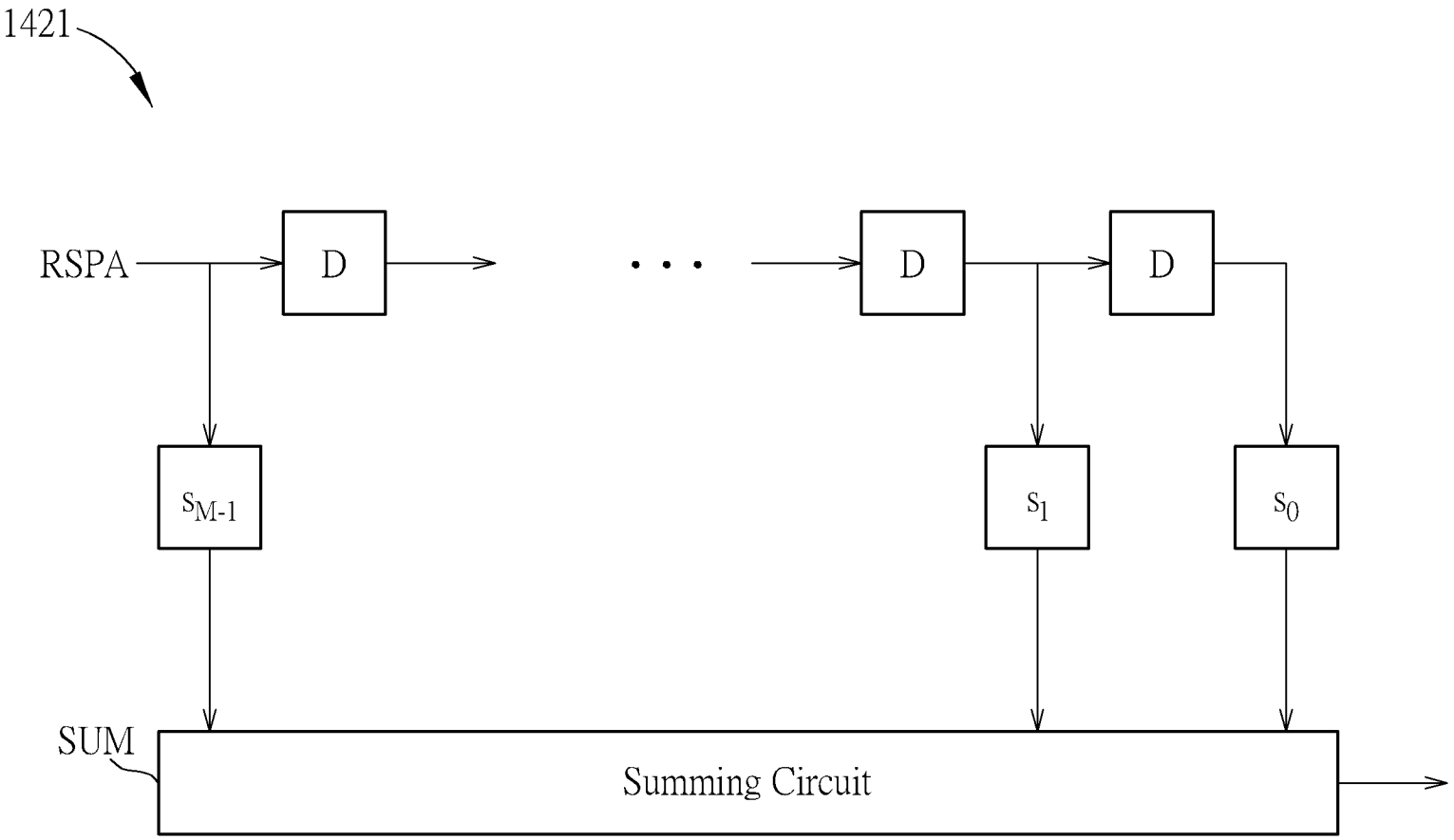
FIG. 2 is a schematic diagram of a first filter according to an embodiment of the present application.

FIG. 2 is a schematic diagram of the first filter 1421 according to an embodiment of the present application. In the embodiment illustrated in FIG. 2, the first filter 1421 has the same circuit topology as a typical FIR filter, comprising (M−1) delay elements D and a summing circuit SUM. The first filter 1421 has a plurality of first coefficients $c_0, \ldots, c_M$, which would be corresponding to the sequence elements $s_0, \ldots, s_M$. Note that, since the first coefficient $c_0, \ldots, c_M$ may be in a set of {+1, −1} or in a set of {+1, 0, −1}, no multiplication/multiplicator is needed. Hence, the first filter 1421 may be realized by simplified FIR circuit which comprises no multiplier, but only delay elements and adders.

The second filter 1422 may be also a finite impulse response (FIR) filter with floating point filter coefficients, meaning that second filter coefficients of the second filter 1422 are in a floating point format. Compared to the first filter 1421, the second filter 1422 has much finer granularity in temporal delay and in coefficient amplitude. The second filter 1422 is configured to perform a waveform level filtering operation, and a second impulse response of the second filter 1422, expressed as H2(t), comprises a component which is proportional to a time-reversed or a time-reversed-and-conjugated version of the sounding pulse waveform UPW. For example, given that the sounding pulse waveform UPW is mathematically expressed as p(t) with finite duration $T_{cycle}$, the second impulse response H2(t) of the second filter 1422 can be expressed as $H2(t)=p(-t)$, $H2(t)=p^*(-t)$, $H2(t)=p(T_{cycle}-t)$ or $H2(t)=p^*(T_{cycle}-t)$.

$T_{cycle}$ represents the pulse cycle of the sounding pulse waveform UPW, and a reciprocal of the pulse cycle $T_{cycle}$ is higher than a maximum human audible frequency. For example, the pulse cycle $T_{cycle}$ may be 25 μs, which is corresponding to a pulse rate of 40 KHz.

Note that, the filtering operation of the filtering circuit 142 may be regarded as a match-filtering operation, which matched to the component sounding pules SP that makes up the sounding sequence SS and the sounding pulse waveform corresponding to SP is UPW. That is, an impulse response H(t) of the filtering circuit 142 comprises a component which is proportional to a time-reversed or a time-reversed-and-conjugated version of the sounding pulse array SPA. For example, an overall impulse response H(t) of the filtering circuit 142 may be expressed as $H(t)=SPA(M\cdot T_{cycle}-t)$ or $H(t)=SPA(-t)$, where SPA(t) is a mathematical expression of the sounding pulse array SPA, which may be expressed as $SPA(t)=\Sigma_m s_m \cdot p(t-m\cdot T_{cycle})$.

When the output signal of the sensor 140 comprises the component corresponding to the received sounding pulse array RSPA (or corresponding to the sounding sequence SS), a spike would appear in the overall filtering result FR of the filtering circuit 142, and the spike is corresponding to one channel path h_l within the multipath channel h. Practically, within the walled-in environment or through the multipath channel h, the overall filtering result FR of the filtering circuit 142 would comprise a plurality of spikes, which may be corresponding to the plurality of channel paths h_0, . . . h_L. If the output signal of the sensor 140 comprises no component corresponding to the sounding sequence SS, then no spike would appear in the overall filtering result FR, and the overall filtering result FR without spikes can be treated as noise.

Figure 3:
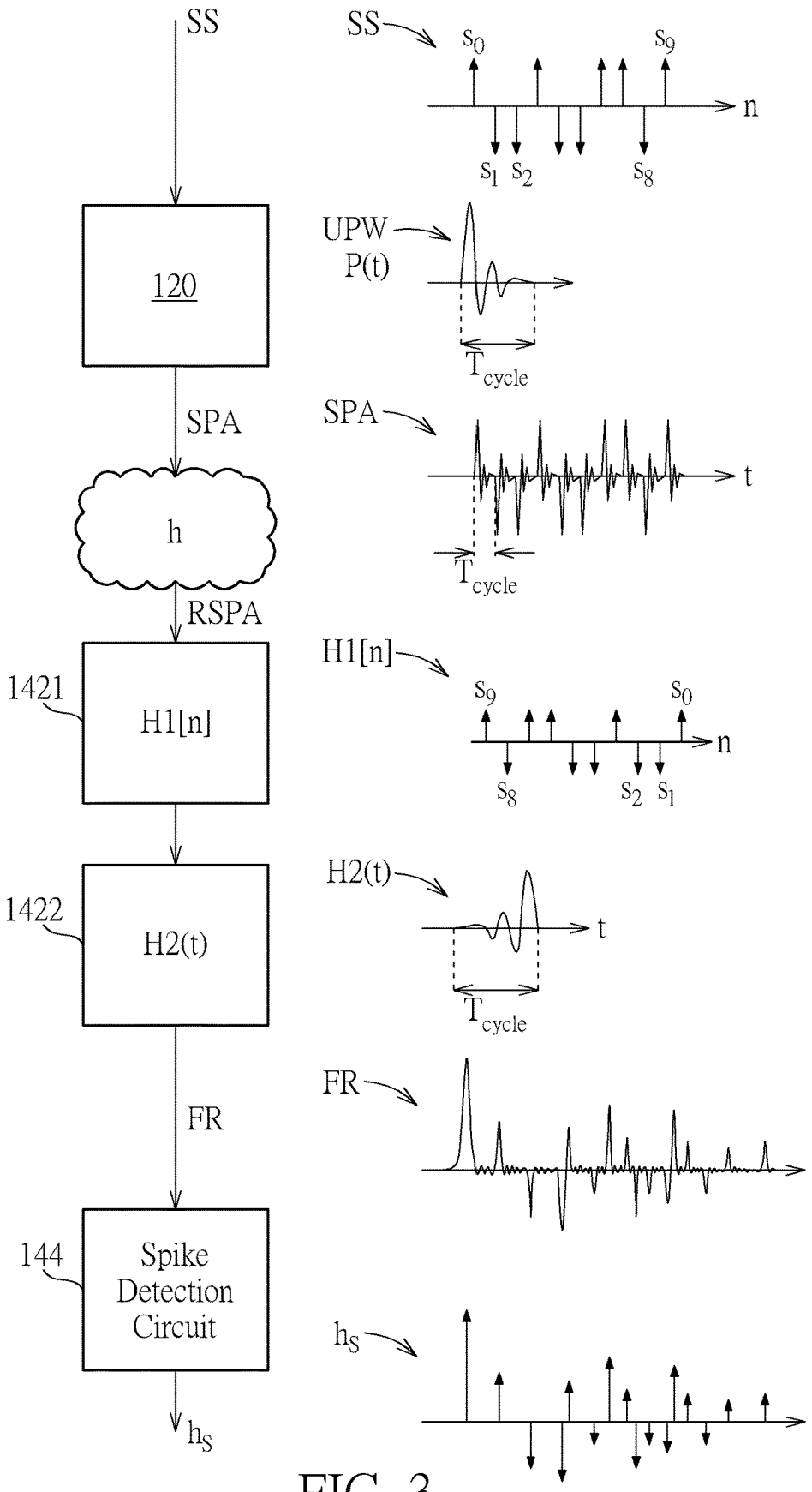
FIG. 3 is a schematic diagram of a plurality of waveforms according to an embodiment of the present application.

FIG. 3 illustrates waveforms of the sounding sequence SS, the sounding pulse waveform UPW/p(t), the sounding pulse array SPA, the first impulse response H1[n] of the first filter 1421, the second impulse response H2(t) of the second filter 1422, the overall filtering result FR output from the filtering circuit 142 and the estimated CIR $h_S$ output from the spike detection circuit 144. In the embodiment illustrated in FIG. 3, the sounding sequence SS is $SS=\{s_0=+1, s_1=-1, s_2=-1, s_3=+1, s_4=-1, s_5=-1, s_6=+1, s_7=+1, s_8=-1, s_9=+1\}$. The sounding pulse array SPA is corresponding to the sounding sequence SS. The first impulse response H1[n] is the time-reversed version of the sounding sequence SS, and the second impulse response H2(t) is the time-reversed version of the sounding pulse waveform UPW. In this case, the overall filtering result FR would comprise a plurality of spikes. After spike detection, the estimated CIR $h_S$ is obtained.

Note that, the pulse array PA generated according to the input audio signal A(t) comprising no component corresponding to the sounding sequence SS. The received pulse array RPA corresponding to the pulse array PA (or corresponding to the input audio signal A(t)) would be deconstructed or scrambled after passing through the filtering circuit 142. As a result, filtering result corresponding to the received pulse array RPA of the input audio signal A(t) would comprise no spike, and would be treated as noise and eliminated by the spike detection circuit 144. Therefore this portion of the (received) pulse array (R)PA would have no impact on the sounding operation. As a result, the sounding pulse array SPA can be superimposed on the pulse array PA and transmitted concurrently with the pulse array PA.

Different from the sounding operation of Ser. No. 16/551,685, in which only one sounding pulse is transmitted for each sounding operation, the sounding system 11 transmits the plurality of sounding pulses SP for each sounding operation, where the plurality of sounding pulses SP is generated according to the sounding sequence SS with low auto-correlation and low cross-correlation in multi-$L_{SC}$ scenarios. Since the (received) pulse array (R)PA corresponding to the input audio signal A(t)) comprises no component related to the sounding sequence SS, the (received) pulse array (R)PA would have no impact on the sounding operation. In this case, the sound producing operation and the sounding operation can be performed concurrently.

Compared to Ser. No. 16/551,685, in which a channel probing phase separated from a transmission phase is needed, the listener does not have to wait until the channel probing phase is expired. When the sound producing system 10 and the sounding system 11 are adopted, the sounding operation can be performed while the listener listens to music or audio content (which is corresponding to the input audio signal A(t)).

Furthermore, the sound producing point $L_{SP}$ and the sound constructing point $L_{SC}$ do not have to be fixed location. Both of the sound producing point $L_{SP}$ and the sound constructing point $L_{SC}$ can be time varying. For example, the sound constructing point $L_{SC}$ can vary/move as the listener walks around the environment.

Figure 4:
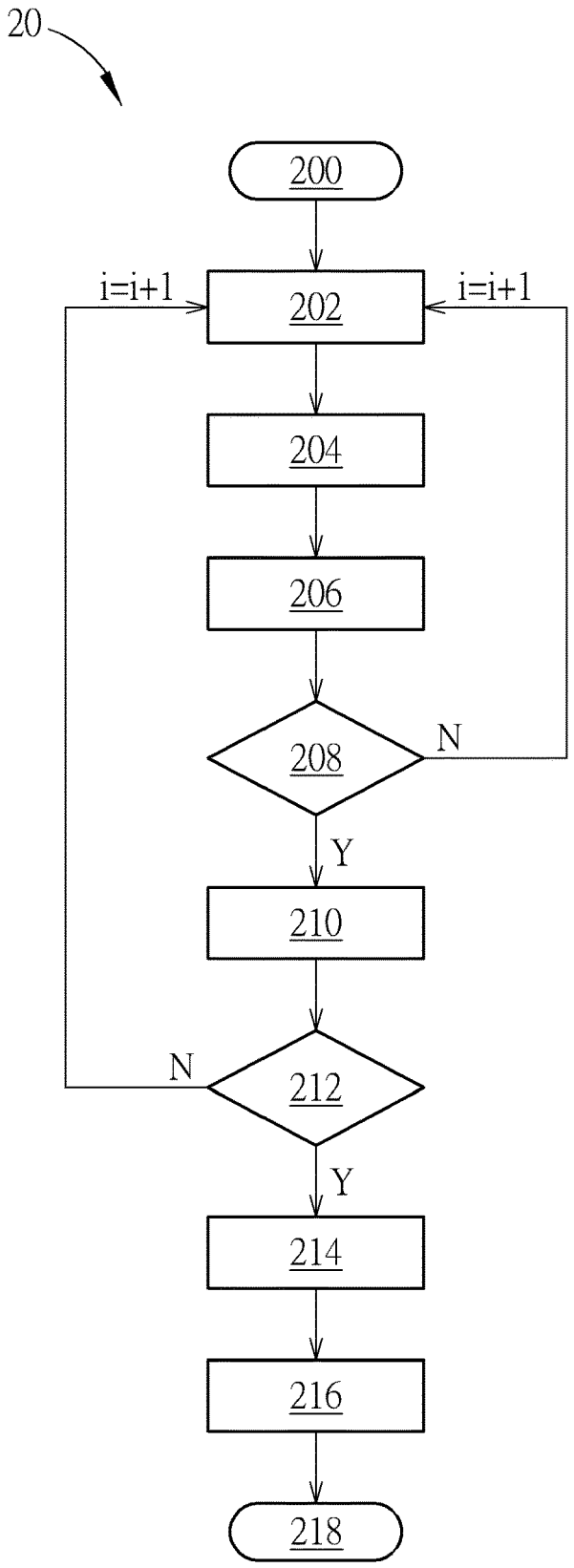
FIG. 4 is a schematic diagram of a spike detection process according to an embodiment of the present application.

Details of the spike detection operation performed by the spike detection circuit 144 are not limited. In an embodiment, the spike detection circuit 144 may execute a spike detection process 20. FIG. 4 is a schematic diagram of the spike detection process 20 according to an embodiment of the present application. As illustrated in FIG. 4, the spike detection process 20 comprises the following step:

Step 200: Start.

Step 202: Obtain a sample $D_i$.

Step 204: Obtain an observation time window $W_i$.

Step 206: Obtaining a maximum absolute-sample $$\max_{j\in W_i}|D_j|.$$

Step 208: Determine whether an absolute-sample $|D_i|$ is equal to the maximum absolute-sample $$\max_{j\in W_i}|D_j|.$$

If yes, go to Step 210; otherwise, go to Step 202.

Step 210: Append the sample $D_i$ and a time instant $t_i$ into a list LST.

Step 212: Determine whether i is equal to a sample length SL. If yes, go to Step 214; otherwise, go to Step 202.

Step 214: Select a plurality of selected pairs from the plurality of pairs.

Step 216: Form the estimated CIR $h_S$ according to the plurality of selected pairs.

Step 218: End.

In Step 200, the overall filtering result FR may be converted into or sampled as a plurality of samples $D_0, \ldots, D_{SL-1}$. For example, the sample $D_i$ may be represented as $D_i=FR(t)|_{t=i\cdot TS+TOT}$, where TS represents a sample time interval, TOT represents an initial time at which FR(t) begins to be sampled, i.e., $D_0=FR(t)|_{t=TOT}$, FR(t) is a continuous time function representing the overall filtering result FR, and SL represents a sample length of the samples $D_0, \ldots, D_{SL-1}$.

In Step 202, the spike detection circuit 144 sequentially obtains the sample $D_i$ for i=0, . . . , SL−1. Initially, the spike detection circuit 144 obtains the initial sample $D_0$ at the first/initial time executing Step 202. After that, at the i-th time the spike detection circuit 144 executes Step 202, the spike detection circuit 144 obtains the sample $D_{i-1}$.

In Step 204, the spike detection circuit 144 obtains an observation time window $W_i$. In an embodiment, the observation time window $W_i$ may be represented by a set of time indices. For example, the observation time window $W_i$ may be $W_i=\{0, \ldots, i, \ldots, i+r\}$ for i<r, $W_i=\{i-r, \ldots, i, \ldots, i+r\}$ for r<i≤SL−r−1, which is centered at the time index i, and $W_i=\{i-r, \ldots, i, \ldots, SL-1\}$ for i>SL−r−1. The time index i is corresponding to the time instant (i·TS+TOT). The observation time window $W_i$ has a specific window width (2·r+1), where a parameter r is configured to determine the window width.

In Step 206, the spike detection circuit 144 obtains a maximum absolute-sample $$\max_{j\in W_i}|D_j|.$$

The maximum absolute-sample $$\max_{j\in W_i}|D_j|$$

satisfies that $$\max_{j\in W_i}|D_j| \geq |D_j|$$

for all j within the observation time window $W_i$. For example, given $W_i=\{i-r, \ldots, i, \ldots, i+r\}$, the maximum absolute-sample $$\max_{j\in W_i}|D_j|$$

is a maximum of a plurality of absolute-samples $|D_j|$ of a plurality of second samples $D_{i-r}, \ldots, D_{i+r}$ within the observation time window $W_i$. The absolute-sample $|D_j|$ among the plurality of absolute-samples $|D_{i-r}|, \ldots, |D_{i+r}|$ is an absolute value of the sample $D_j$ among the plurality of second samples $D_{i-r}, \ldots, D_{i+r}$.

In Step 208, the spike detection circuit 144 determines whether the absolute-sample $|D_i|$ received at the current iteration is equal to the maximum absolute-sample $$\max_{j\in W_i}|D_j|.$$

If yes, implying that the sample $D_i$ is either a local maximum (representing a peak of a positive spike) or a local minimum (representing a peak of a negative spike), the spike detection circuit 144 would append the sample $D_i$ and the time instant $t_i$ corresponding to the time index i (e.g., $t_i$=i·TS+TOT) of sample $D_i$ as a pair $(D_i, t_i)$ into the list LST (Step 210). If not, the spike detection circuit 144 goes to Step 202 to perform Steps 204 and 206 on the next sample $D_{i+1}$, with performing i=i+1.

In Step 212, the spike detection circuit 144 checks if the time index i is equal to SL−1, the sample length SL minus 1. When the time index i is equal to the sample length SL minus 1, it means that all samples $D_0, \ldots, D_{SL-1}$ have been performed and the spike detection circuit 144 would go to Step 214. Otherwise, the spike detection circuit 144 would again perform i=i+1 and go to Step 202.

Before entering Step 214, the list LST should comprise a plurality of pairs, denoted as PR pairs $(D_p, t_p)$, where PR represents a number of pairs within the list LST. In Step 214, the spike detection circuit 144 selects the CL pairs $(D_{p,(S)}, t_{p,(S)})$ with the corresponding absolute-samples $|D_{p,S)}|$ lbeing the CL largest absolute-samples among all of the absolute-samples $|D_p|$ of the plurality of pairs $(D_p, t_p)$. CL represents a number of channel path of the estimated CIR $h_S(t)$. In an embodiment, the spike detection circuit 144 may perform a sorting operation on all of the absolute-samples $|D_p|$ of all pairs $(D_p, t_p)$ within the list LST in a descending order, select the CL largest absolute-samples $|D_{p,(S)}|$, and select the CL selected pairs $(D_{p,(S)}, t_{p,(S)})$. Note that, the absolute-sample $|D_{p,(S)}|$ is larger than an (or any) unselected absolute-sample $|D_{p,(R)}|$, i.e., $|D_{p,(S)}|>|D_{p,(R)}|$.

Figure 5:
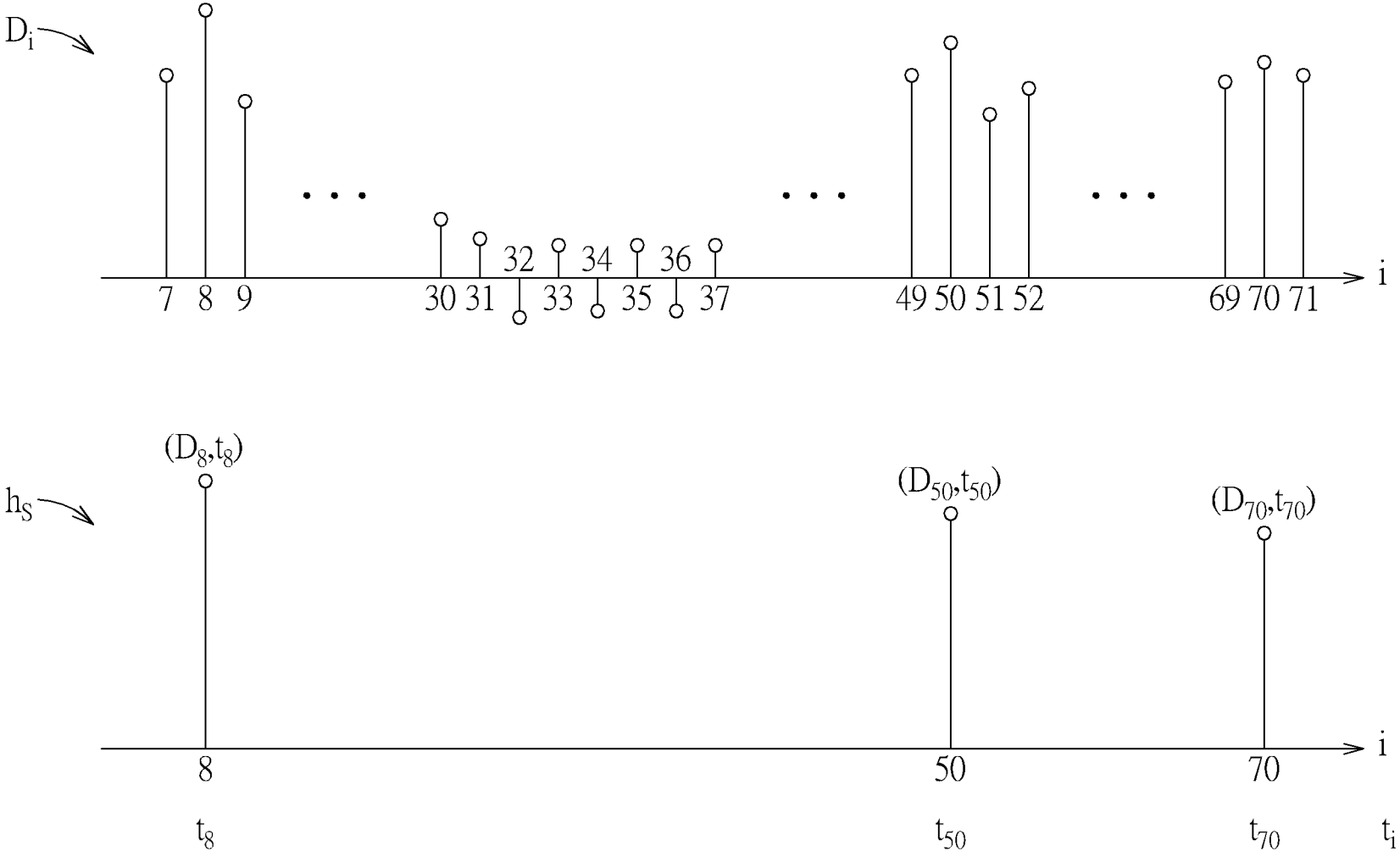
FIG. 5 is a schematic diagram of a plurality of waveforms according to an embodiment of the present application.

FIG. 5 is a schematic diagram of waveforms of the samples $D_i$ (before the spike detection process 20 is performed) and the estimated CIR $h_S$ (after the spike detection process 20 is performed). For brevity, FIG. 5 only illustrates the samples $D_i$ for i=7, . . . , 71. By performing the process 20, the samples $D_7, D_9, D_{49}, D_{51}, D_{52}, D_{69}, D_{71}$ would be discarded by performing Step 208 as they are not local maximum, and the samples $D_{30}, \ldots, D_{37}$ would be discarded by performing Step 214 as they are not sufficiently significant. As a result, after performing Step 214, only pairs $(D_8, t_8)$, $(D_{50}, t_{50})$ and $(D_{70}, t_{70})$ are selected as the selected pairs, the estimated CIR $h_S$ can be formed (at least) by the selected pairs $(D_8, t_8)$, $(D_{50}, t_{50})$ and $(D_{70}, t_{70})$.

Figure 6:
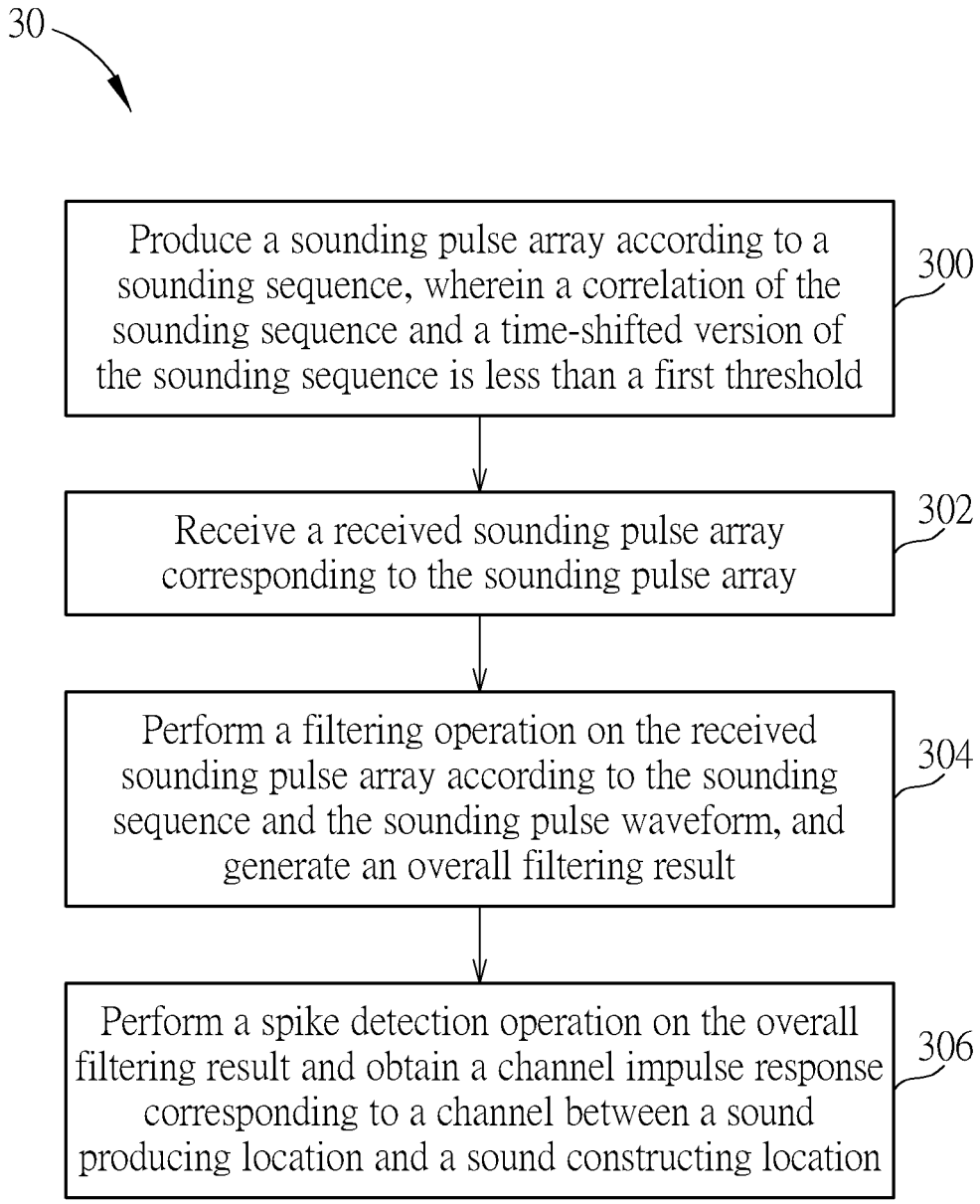
FIG. 6 is a schematic diagram of a sounding process according to an embodiment of the present application.

Operations of the sounding system 11 can be summarized into a sounding process 30, which is illustrated in FIG. 6. The sounding process 30 comprises:

Step 300: Produce a sounding pulse array according to a sounding sequence, wherein a correlation of the sounding sequence and a time-shifted version of the sounding sequence is less than a first threshold.

Step 302: Receive a received sounding pulse array corresponding to the sounding pulse array.

Step 304: Perform a filtering operation on the received sounding pulse array according to the sounding sequence and the sounding pulse waveform, and generate an overall filtering result.

Step 306: Perform a spike detection operation on the overall filtering result and obtain a channel impulse response corresponding to a channel between a sound producing location and a sound constructing location.

Details of the sounding process 30 may be referred to the paragraphs stated in the above, which are not narrated for brevity.

Figure 7:
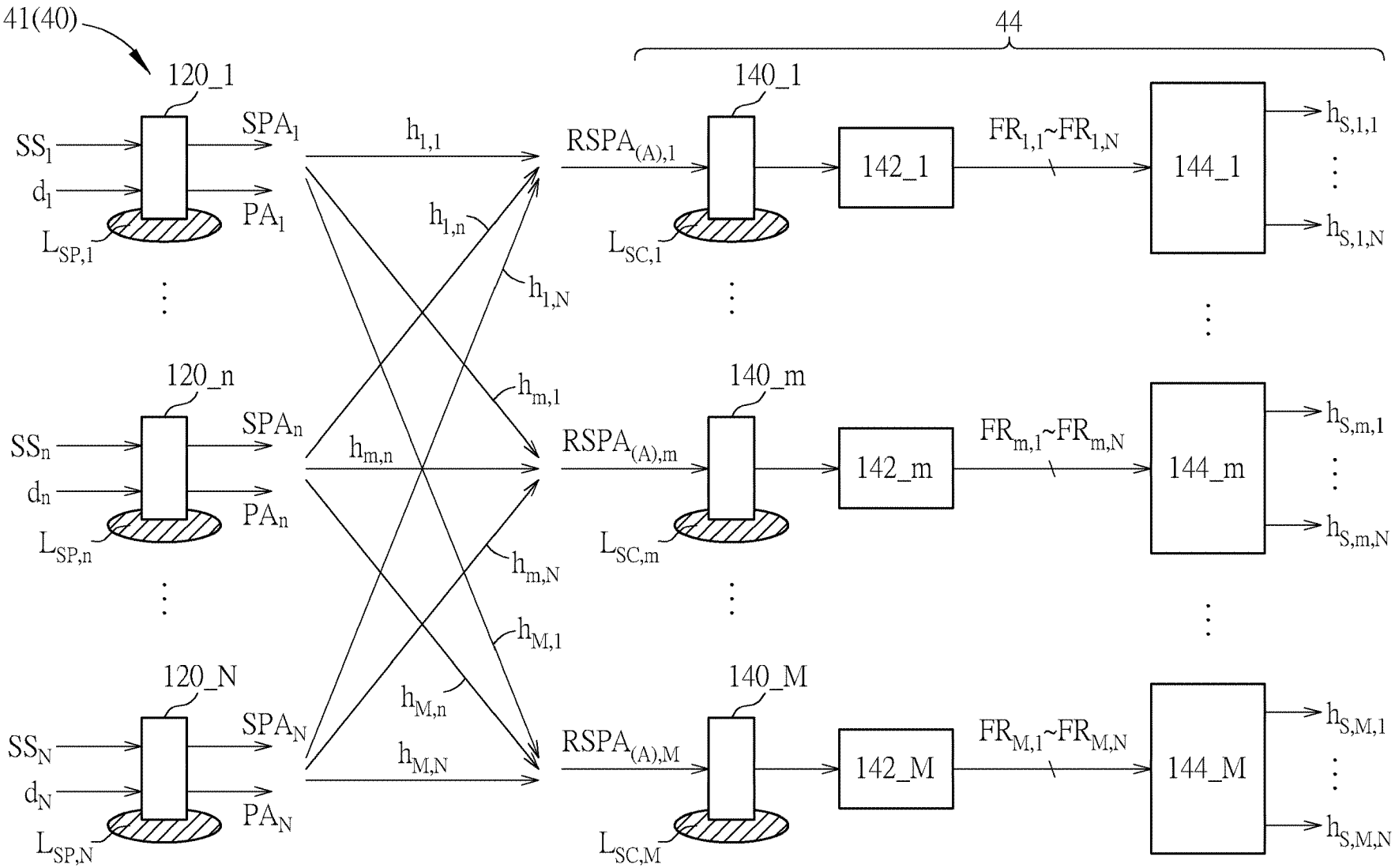
FIG. 7 is a schematic diagram of a sounding system according to an embodiment of the present application.

The concept of the sounding system 11 can be extended to a multi-SPD multi-sensor sounding system. FIG. 7 is a schematic diagram of a sounding system 41 according to an embodiment of the present application. The sounding system 41 comprises a sounding circuit 44 and a plurality of SPDs 120_1,. . . , 120_N, disposed at a plurality of sound producing locations $L_{SP,1}$, . . . , $L_{SP,N}$, respectively. Each SPD 120_n can be realized by the SPD 120. In FIG. 7, the membrane within the SPD is omitted for brevity. The sounding circuit 44 comprises a plurality of sensors 140_1, . . . , 140_M, disposed at a plurality of sound constructing locations $L_{SC,1}$, . . . , $L_{SC,M}$, respectively. The sounding circuit 44 may also comprise a plurality of filtering circuits 142_1, . . . , 142_m and a plurality of spike detection circuits 144_1, . . . , 144_M, which are coupled to the plurality of sensors 140_1, . . . , 140_M, respectively. Between the sound producing locations $L_{SP,1}$, . . . , $L_{SP,N}$ and the sound constructing locations $L_{SC,1}$, $L_{SC,M}$, a plurality of channels $h_{1,1}$, . . . , $h_{1,N}$, . . . , $h_{m,1}$, . . . , $h_{m,N}$, $h_{M,1}$, . . . , $h_{M,N}$ is formed. Each channel $h_{m,n}$ is a multipath channel.

Each SPD 120_n receives a sounding sequence $SS_n$ and produces a sounding pulse array $SPA_n$ according to the sounding sequence $SS_n$. The plurality of SPDs 120_1, . . . , 120_N receives a plurality of sounding sequences $SS_1$, . . . , $SS_N$ and produces a plurality of sounding pulse arrays $SPA_1$, . . . , $SPA_N$, according to the plurality of sounding sequences $SS_1$, . . . , $SS_N$. The sounding sequences $SS_1$, . . . , $SS_N$ may have low cross-correlation, meaning that a correlation between a first sounding sequence $SS_{n1}$ and a second sounding sequence $SS_{n2}$ would be less than a second threshold. The second threshold may be, e.g., 1% of an energy of the sounding sequence. The sounding sequences $SS_1$, . . . , $SS_N$ may be realized by the PN sequence, where a plurality of PN sequences is mutually orthogonal.

Each sensor 140_m may receive an aggregated received sounding pulse array $RSPA_{(A),m}$. The aggregated received sounding pulse array $RSPA_{(A),m}$, received at the sensor 140_m, is an aggregation of the plurality of sounding pulse arrays $SPA_1$, . . . , $SPA_N$ due to the channels $h_{m,1}$, . . . , $h_{m,N}$. That is, the aggregation is naturally performed by the channels $h_{m,1}$, . . . , $h_{m,N}$. Specifically, the aggregated received sounding pulse array $RSPA_{(A),m}$ comprises a component which can be expressed as $h_{m,1} \cdot SPA_1 + \ldots + h_{m,N} \cdot SPA_N$.

Figure 8:
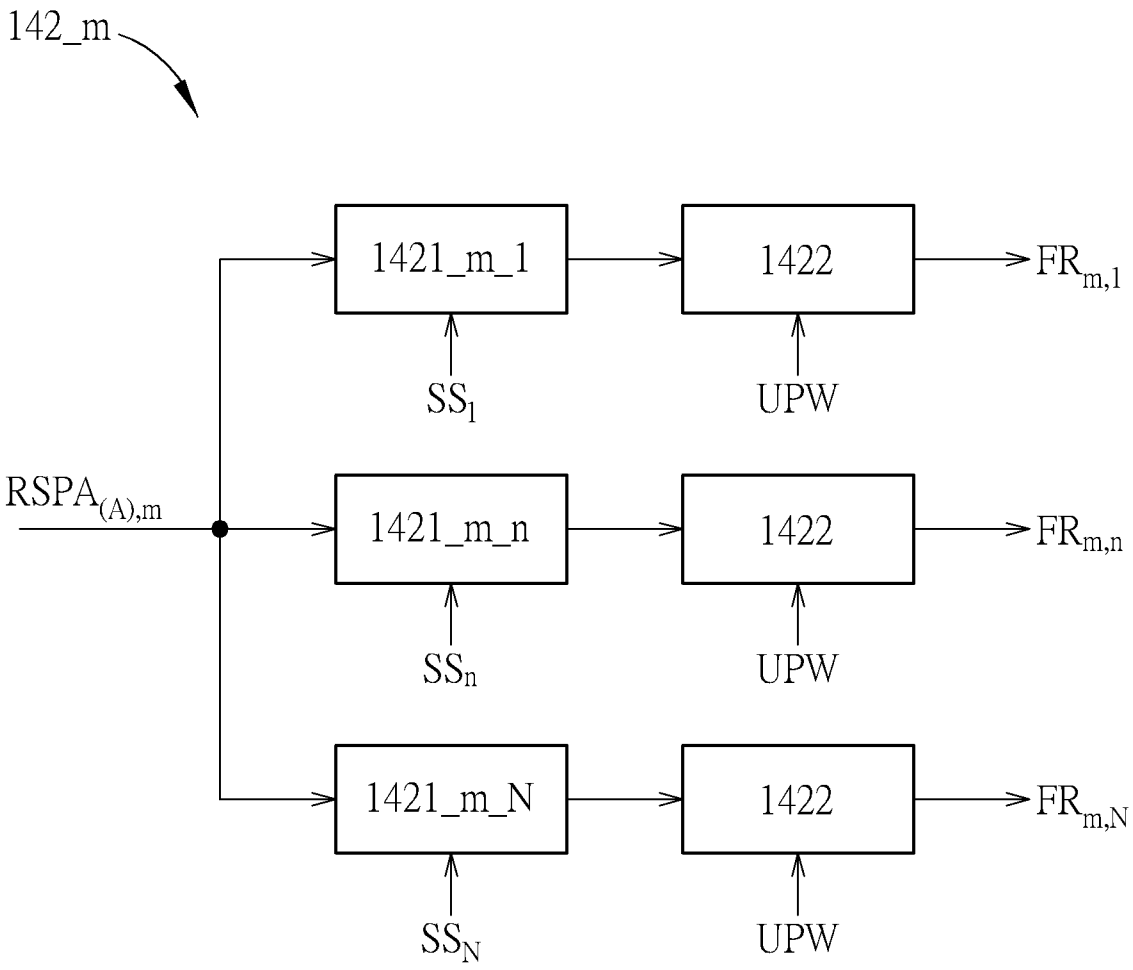
FIG. 8 is a schematic diagram of a filtering circuit according to an embodiment of the present application.

The filtering circuit 142_m may perform a plurality of (overall) filtering operations on the aggregated received sounding pulse array $RSPA_{(A),m}$, and generate a plurality of overall filtering results $FR_{m,1}$, . . . , $FR_{m,N}$. FIG. 8 is a schematic diagram of the filtering circuit 142_m according to an embodiment of the present application. The filtering circuit 142_m comprises a plurality of first filters 1421_m_1, . . . , 1421_m_N and a plurality of second filter filters 1422. Each first filter 1421_m_n, among the plurality of first filters 1421_m_1, . . . , 1421_m_N, may perform a sequence-level filtering operation (similar to the first filter 1421) on the aggregated received sounding pulse array $RSPA_{(A),m}$ according to the sounding sequence $SS_1$, and the corresponding second filter 1422 may perform a waveform-level filtering operation (similar to the second filter 1422) on an output of the first filter 1421_m_n according to the sounding pulse waveform UPW. Therefore, the filtering circuit 142_m can generate the plurality of overall filtering results $FR_{m,1}$, . . . $FR_{m,N}$. According to the plurality of overall filtering results $FR_{m,1}$, . . . , $FR_{m,N}$, the spike detection circuit 144_m can generate estimated CIRs $h_{S,m,1}$, . . . $h_{S,m,N}$. In addition, the estimated CIRs $h_{sS1,1}$, . . . , $h_{S,1,N}$, . . . , $h_{S,m,1}$, . . . $h_{S,m,N}$, $h_{S,M,1}$, . . . , $h_{S,M,N}$ the different sound producing locations and the difference sound constructing locations can be generated concurrently.

Note that, in the embodiment illustrated in FIG. 8, the plurality of the sequence-level filtering operations is performed parallelly, by the first filter filters 1421_m_1, . . . , 1421_m_N, which is not limited thereto. The sounding circuit may perform the plurality of the sequence-level filtering operations serially (or sequentially), which is also within the scope of the present application. In addition, the plurality of first filter filters 1421_m_1, . . . , 1421_m_N and the plurality of second filter filters 1422 are functionally distinguished, the plurality of first filters 1421_m_1, . . . , 1421_m_N and/or the plurality of second filter filters 1422 may be integrated in different realization.

In addition, since the sounding sequences $SS_1$, . . . , $SS_N$ have low cross-correlation with each other (or the sounding sequences $SS_1$, . . . , $SS_N$ are mutually orthogonal), the plurality of sounding pulse arrays $SPA_1$, . . . , $SPA_N$ would not interfere with each other when performing the sounding operation, the plurality of sounding pulse arrays $SPA_1$, . . . , $SPA_N$ can be transmitted concurrently.

In another perspective, FIG.7 can also be regarded as a portion of a sound producing system 40, where the driving circuit(s) and the signal processing circuit(s) of the sound producing system 40 are omitted, and only the SPDs 120_1, . . . , 120_N and the sounding circuit 44 (with details therein) are illustrated. It can be regarded that the sounding system 41 is integrated into the sound producing system 40, in which the sound producing operation is performed.

For the sound producing operation, the SPDs 120_1, . . . , 120_N receive a plurality of driving signals $d_1$, . . . , $d_N$ to produce a plurality of pulse arrays $PA_1$, . . . , $PA_N$, respectively. Since the plurality of pulse arrays $PA_1$, . . . , $PA_N$ would not affect the sounding operation, the sounding pulse array $SPA_n$, for the sounding operation can be imposed on the pulse array $PA_n$, for the sound producing operation. Thus, the pulse arrays $PA_1$, . . . , $PA_N$ and the sounding pulse arrays $SPA_1$, . . . , $SPA_N$ can be transmitted concurrently.

Note that, the sounding system 11 is a single-SPD single-sensor sounding system, and the sounding system 41 is a multi-SPD multi-sensor sounding system. Based on the rationale behind the sounding systems 11 and 41, the sounding system 41 can be degenerated to a single-SPD multi-sensor sounding system or a multi-SPD single-sensor sounding system.

Figure 9:
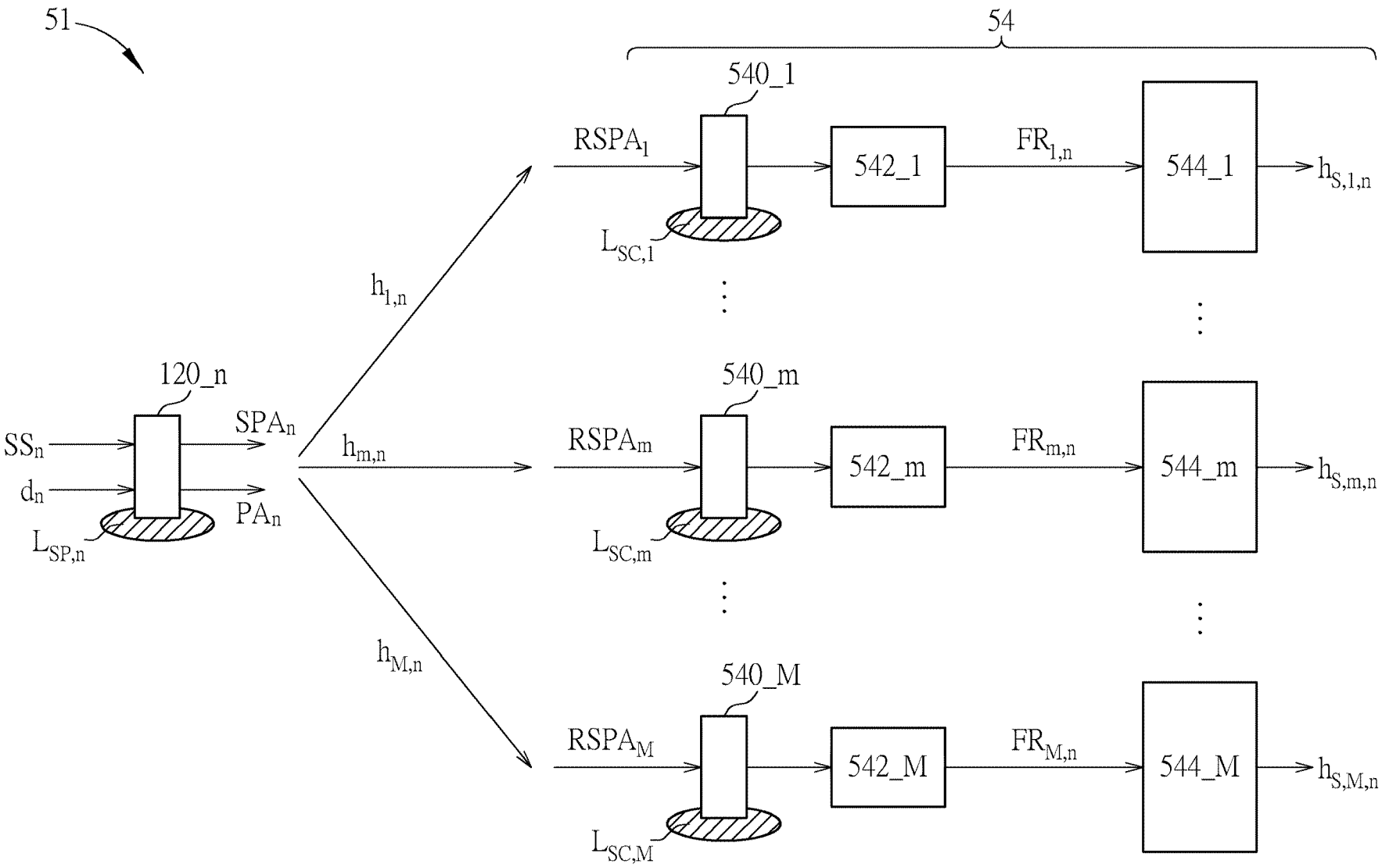
FIG. 9 is a schematic diagram of a sounding system according to an embodiment of the present application.

For example, FIG. 9 is a schematic diagram of a sounding system 51 according to an embodiment of the present application. The sounding system 51 is similar to the sounding systems 11 and 41. Different from the sounding systems 11 and 41, the sounding system 51 is a single-SPD multi-sensor sounding system. Specifically, the sounding system 51 comprises a sounding circuit 54 and a SPD 520_n disposed at a sound producing location $L_{SP,n}$. The sounding circuit 54 comprises a plurality of sensors 540_1, . . . , 540_M, a plurality of filtering circuits 542_1, . . . , 542_M and a plurality of spike detection circuits 544_1, . . . , 544_M. The sensors 540_1, . . . , 540_M are disposed at a plurality of sound constructing locations $L_{SC,1}$, . . . , $L_{SC,M}$ and receives received sounding pulse array $RSPA_1$, . . . , $RSPA_M$, respectively. The filtering circuits 542_1, . . . , 542_M have similar structure as the filtering circuit 142, where the sequence level filtering operations of the filtering circuits 542_1, . . . , 542_M are performed according to the sounding sequence $SS_n$ received by the SPD 520_n, such that the filtering circuits 542_1, . . . , 542_M produce overall filtering results $FR_{1,n}$, . . . , $FR_{M,n}$. The spike detection circuits 544_1, . . . , 544_M have similar structure as the spike detection circuit 144. The spike detection circuits 544_1, . . . , 544_M generates estimated CIRs $h_{S,1,n}$, . . . , $h_{S,M,n}$ according to the overall filtering results $FR_{1,n}$, . . . , $FR_{M,n}$. Hence, the sounding operation for the channels $h_{1,n}$, . . . , $h_{M,n}$ can be performed concurrently.

Figure 10:
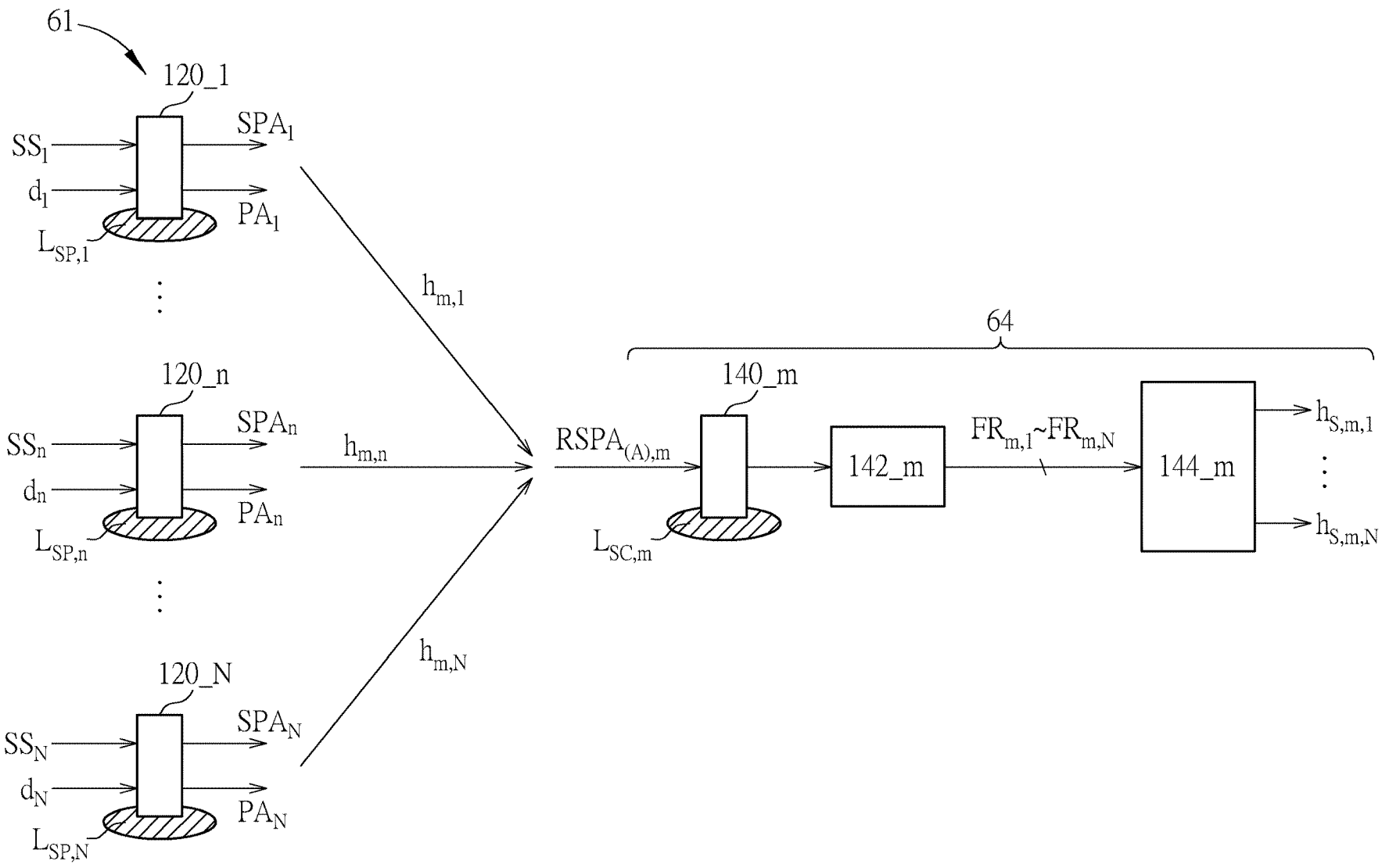
FIG. 10 is a schematic diagram of a sounding system according to an embodiment of the present application.

FIG. 10 is a schematic diagram of a sounding system 61 according to an embodiment of the present application. Different from the sounding systems 11 and 41, the sounding system 61 is a multi-SPD single-sensor sounding system. Operation details of the sounding system 61 are similar to which of the sounding systems 11 and 41, which is not narrated herein for brevity.

All of the sounding systems in the above can be integrated into the sound producing systems disclosed in Ser. No. 16/551,685.

In summary, the present application utilizes the sounding sequence with low auto-correlation to produce the sounding pulse array. The sounding pulse array for the sounding operation would not be affected by the pulse array, which is intended for the sound producing operation and generated according to the input audio signal. Thereby, the sounding pulse array for the sounding operation can be superimposed on the pulse array for the sound producing operation and transmit concurrently with the pulse array for the sound producing operation.

In addition, the present application utilizes the plurality of sounding sequences with low cross-correlation to produce the plurality of sounding pulse arrays from different SPDs, or from one SPD to multiple sound construction locations. In addition to the feature that the sounding pulse arrays (for the sounding operation) and the pulse arrays (for the sound producing operation) can be transmitted concurrently, the plurality of CIRs between the different sound producing locations and the difference sound constructing locations can be generated concurrently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sounding system, configured to perform a sounding operation, the sounding system comprising:

a sound producing device, comprising a membrane, disposed at a sound producing location, receiving a sounding sequence, configured to produce a sounding pulse array according to the sounding sequence, wherein the sounding pulse array comprises a plurality of sounding pules, and each sounding pulse is corresponding to a sounding pulse waveform; and a sounding circuit, configured to generate a channel impulse response corresponding to a channel between the sound producing location and a sound constructing location, the sounding circuit comprising:

a sensor, disposed at the sound constructing location, receiving a received sounding pulse array corresponding to the sounding pulse array, wherein the received sounding pulse array comprises a plurality of received sounding pulses; and a filtering circuit, coupled to the sensor, configured to generate an overall filtering result, wherein the sounding circuit generates the channel impulse response according to the overall filtering result;

wherein the sounding system is integrated into a sound producing system;

wherein the sound producing system comprises the sound producing device disposed at the sound producing location;

wherein the sound producing device produces a pulse array corresponding to an input audio signal, and the pulse array comprises a plurality of air pulses;

wherein the pulse array is generated according to the channel impulse response and transmitted from the sound producing location, and propagates through the channel, such that a sound pressure level envelope corresponding to the input audio signal is constructed at the sound constructing location.

2. The sounding system of claim 1, wherein a correlation of the sounding sequence and a time-shifted version of the sounding sequence is less than a first threshold, and the first threshold is 1% of an energy of the sounding sequence.

3. The sounding system of claim 1, wherein the sounding sequence comprises a plurality of sequence elements, a value of a sequence element is binary or ternary.

4. The sounding system of claim 1, wherein a sounding pulse among the plurality of sounding pulses has a pulse cycle, and a reciprocal of the pulse cycle is higher than a maximum human audible frequency.

5. The sounding system of claim 1, wherein the filtering circuit is configured to perform a filtering operation on the received sounding pulse array according to the sounding sequence and the sounding pulse waveform.

6. The sounding system of claim 1, wherein the filtering circuit comprises:

a first filter, coupled to the sensor, configured to perform a first filtering operation according to the sounding sequence; and a second filter, coupled to the first filter, configured to perform a second filtering operation according to the sounding pulse waveform.

7. The sounding system of claim 6, wherein a first impulse response of the first filter comprises a component which is proportional to a time-reversed or a time-reversed-and-conjugated version of the sounding sequence.

8. The sounding system of claim 6, wherein the first filter comprises no multiplier but comprises a plurality of delay elements and a summing circuit.

9. The sounding system of claim 6, wherein the first filter has a plurality of filter coefficients, the plurality of filter coefficients is in an integer format and in a set of $\{+1, -1\}$ or $\{+1, 0, -1\}$.

10. The sounding system of claim 6, wherein a second impulse response of the second filter comprises a component which is proportional to a time-reversed or a time-reversed-and-conjugated version of the sounding pulse waveform.

11. The sounding system of claim 1, wherein the sounding circuit comprises a spike detection circuit, coupled to the filtering circuit, configured to perform a spike detection operation on the overall filtering result, so as to obtain the channel impulse response corresponding to a channel between the sound producing location and the sound constructing location.

12. The sounding system of claim 11, wherein the overall filtering result is represented by a plurality of samples, the spike detection circuit is configured to perform the following steps, to perform the spike detection operation on the overall filtering result and obtain the channel impulse response:

obtaining a first sample, where in the first sample is corresponding to a first time instant;

obtaining a first observation time window, wherein the first observation time window comprises the first time instant, and the first observation time window has a specific width;

obtaining a first maximum absolute-sample corresponding to the first observation time window, wherein the first maximum absolute-sample is a maximum of a plurality of absolute-samples of a plurality of second samples within the first observation time window, an absolute-sample among the plurality of absolute-samples is an absolute value of a second sample among the plurality of second samples;

determining whether a first absolute-sample is equal to the first maximum absolute-sample, wherein the first absolute-sample is an absolute value of the first sample;

appending the first sample and the first time instant into a list; and obtaining the channel impulse response according to the list.

13. The sounding system of claim 12, wherein the list comprises a plurality of pairs, the plurality of pairs comprises a plurality of third samples and a plurality of third time instants corresponding to the plurality of third samples, the spike detection circuit is further configured to perform the following steps, to perform the spike detection operation on the overall filtering result and obtain the channel impulse response:

selecting a plurality of selected pairs from the plurality of pairs, wherein a plurality of selected third absolute-samples is larger than a unselected third absolute-sample; and forming the channel impulse response according to the plurality of selected pairs.

14. The sounding system of claim 1, wherein the sound producing system comprises a sound producing apparatus, the sound producing apparatus comprises:

a signal processing circuit, coupled to the spike detection circuit, configured to generate a channel-shaping signal according to the channel impulse response;

a driving circuit, coupled to the signal processing circuit, receiving the channel-shaping signal and an input audio signal, configured to generate a driving signal according to the input audio signal and the channel-shaping signal; and the sound producing device, configured to produce the pulse array according to the driving signal.

15. The sounding system of claim 14, wherein an air pulse rate of the plurality of air pulses is higher than a maximum human audible frequency.

16. The sounding system of claim 14, wherein the plurality of air pulses produces a non-zero offset in terms of sound pressure level, and the non-zero offset is a deviation from a zero sound pressure level.

17. The sounding system of claim 14, wherein the signal processing circuit generates the channel-shaping signal to be proportional to a time-reversed or a time-reversed-and-conjugated counterpart of the channel impulse response of the channel between the sound producing location and the sound constructing location.

18. The sounding system of claim 14, wherein the plurality of sounding pulses for the sounding operation and the plurality of air pulses corresponding to the input audio signal are superimposed and transmitted concurrently.

19. The sounding system of claim 1, further comprising:

a plurality of sound producing devices, disposed at a plurality of sound producing locations, receiving a plurality of sounding sequences, configured to produce a plurality of sounding pulse arrays according to the plurality of sounding sequences;

wherein the sensor receives a received sounding pulse array, and the received sounding pulse array is an aggregation of the plurality of sounding pulse arrays;

wherein the filtering circuit perform a plurality of filtering operations on the received sounding pulse array according to the plurality of sounding sequences and the sounding pulse waveform, and generate a plurality of overall filtering results;

where the spike detection circuit performs the spike detection operation on the plurality of overall filtering results and obtain a plurality of channel impulse responses corresponding to a plurality of channels;

wherein the plurality of channels is between the plurality of sound producing location and the sound constructing location.

20. The sounding system of claim 19, wherein the plurality of sound producing devices produces a plurality of pulse arrays, the plurality of sounding pulse arrays for the sounding operation and the plurality of pulse arrays are transmitted concurrently.

21. The sounding system of claim 19, wherein a correlation of a first sounding sequence and a second sounding sequence is less than 1% of an energy of the first sounding sequence.

22. The sounding system of claim 1, further comprising:

a plurality of sound producing devices, disposed at a plurality of sound producing locations, receiving a plurality of sounding sequences, configured to produce a plurality of sounding pulse arrays according to the plurality of sounding sequences;

wherein the sounding circuit further comprises a plurality of sensors disposed at a plurality of sound constructing locations, the plurality of sensors receives a plurality of received sounding pulse arrays, the sounding circuit generates a plurality of channel impulse responses corresponding to a plurality of channels according to the plurality of received sounding pulse arrays, the plurality of channels is between the plurality of sound producing locations and the plurality of sound constructing locations.

23. The sounding system of claim 1, wherein the sounding circuit further comprises a plurality of sensors disposed at a plurality of sound constructing locations, the plurality of sensors receives a plurality of received sounding pulse array, the sounding circuit generates a plurality of channel impulse responses corresponding to a plurality of channels, and the plurality of channels is between the sound producing location and the plurality of sound constructing locations.

24. The sounding system of claim 23, wherein the sounding system is integrated into a sound producing system.

25. A sounding method, configured to generate a channel impulse response corresponding to a channel between a sound producing location and a sound constructing location, the sounding method comprising:

producing, by a sound producing device disposed at the sound producing location, a sounding pulse array according to a sounding sequence, wherein the sound producing device comprises a membrane, a correlation of the sounding sequence and a time-shifted version of the sounding sequence is less than a first threshold, the sounding pulse array comprises a plurality of sounding pules, and each sounding pulse is corresponding to a sounding pulse waveform;

receiving, by a sensor disposed at the sound constructing location, a received sounding pulse array corresponding to the sounding pulse array, wherein the received sounding pulse array comprises a plurality of received sounding pulses;

performing a filtering operation on the received sounding pulse array according to the sounding sequence and the sounding pulse waveform, and generate an overall filtering result; and performing a spike detection operation on the overall filtering result to obtain the channel impulse response.

26. The sounding method of claim 25, wherein the first threshold is 1% of an energy of the sounding sequence.

27. The sounding method of claim 25, wherein the step of performing the spike detection operation on the overall filtering result and obtain the channel impulse response comprises:

obtaining a first sample, where in the first sample is corresponding to a first time instant;

obtaining a first observation time window, wherein the first observation time window comprises the first time instant, and the first observation time window has a specific width;

obtaining a first maximum absolute-sample corresponding to the first observation time window, wherein the first maximum absolute-sample is a maximum of a plurality of absolute-samples of a plurality of second samples within the first observation time window, an absolute-sample among the plurality of absolute-samples is an absolute value of a second sample among the plurality of second samples;

determining whether a first absolute-sample is equal to the first maximum absolute-sample, wherein the first absolute-sample is an absolute value of the first sample;

appending the first sample and the first time instant into a list; and obtaining the channel impulse response according to the list.

28. The sounding method of claim 27, wherein the list comprises a plurality of pairs, the plurality of pairs comprises a plurality of third samples and a plurality of third time instants corresponding to the plurality of third samples, the step of performing the spike detection operation on the overall filtering result and obtain the channel impulse response comprises:

selecting a plurality of selected pairs from the plurality of pairs, wherein a plurality of selected third absolute-samples is larger than a unselected third absolute-sample; and forming the channel impulse response according to the plurality of selected pairs.

29. The sounding method of claim 25, further comprising:

receiving a plurality of received sounding pulse array at the plurality of sound constructing locations; and generates a plurality of channel impulse responses corresponding to a plurality of channels;

wherein the plurality of channels is between the sound producing location and the plurality of sound constructing locations.

* * * * *